US006272842B1

(12) United States Patent
Dean

(10) Patent No.: US 6,272,842 B1
(45) Date of Patent: Aug. 14, 2001

(54) COMBUSTOR TUNING

(75) Inventor: Anthony John Dean, Scotia, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/250,912

(22) Filed: Feb. 16, 1999

(51) Int. Cl.[7] ..... F02C 9/00
(52) U.S. Cl. ..... 60/39.23; 60/725; 60/737
(58) Field of Search ..... 60/39.23, 725, 60/737; 431/114; 239/402.5

(56) References Cited

U.S. PATENT DOCUMENTS

| | | | | |
|---|---|---|---|---|
| 3,905,192 | * | 9/1975 | Pierce et al. | 239/402.5 X |
| 4,532,762 | * | 8/1985 | Mongia et al. | 60/39.23 |
| 4,967,550 | | 11/1990 | Acton et al. | 60/39.29 |
| 5,005,353 | | 4/1991 | Acton et al. | 60/39.281 |
| 5,082,421 | | 1/1992 | Acton et al. | 415/118 |
| 5,141,391 | | 8/1992 | Acton et al. | 415/119 |
| 5,211,004 | | 5/1993 | Black | 60/39.27 |
| 5,357,743 | * | 10/1994 | Zarzalis et al. | 60/39.23 |
| 5,373,693 | | 12/1994 | Zarzalis et al. . | |
| 5,428,951 | * | 7/1995 | Wilson et al. | 60/725 X |
| 5,664,412 | * | 9/1997 | Overton | 60/39.23 |
| 5,685,157 | | 11/1997 | Pandalai et al. . | |
| 5,809,769 | * | 9/1998 | Richards et al. | 60/725 X |
| 5,822,992 | * | 10/1998 | Dean | 60/737 |
| 5,918,459 | * | 7/1999 | Nakae | 60/39.23 |
| 5,943,866 | * | 8/1999 | Lovett et al. | 60/737 |

* cited by examiner

*Primary Examiner*—Timothy S. Thorpe
*Assistant Examiner*—David J. Torrente
(74) *Attorney, Agent, or Firm*—Patrick K. Patnode; Douglas E. Stoner

(57) ABSTRACT

A variable length pre-mixer assembly comprises an upstream end for receiving compressed air from a compressor and a downstream end disposed in flow communication with a combustor. Pre-mixer assembly comprises an upstream forward clamp, a swirler assembly having a plurality of circumferentially spaced apart vanes disposed adjacent the upstream end for swirling compressed air channeled therethrough. An elongate centerbody has a first end joined to and extending through the swirler and a second end disposed downstream therefrom. A downstream fuel nozzle shroud has an outlet in flow communication with the combustor. Additionally, at least one removably disposed fuel nozzle spacer is alternatively disposed between a first position between the upstream forward clamp and the swirler assembly and a second position between the swirler assembly and the downstream fuel nozzle so as to change the relative position of the swirler assembly and alter the pre-mixer assemblies acoustical resonance characteristics.

2 Claims, 3 Drawing Sheets

COMBUSTOR TUNING

BACKGROUND OF THE INVENTION

The present invention relates generally to industrial turbine engines, and more specifically, to combustors therein.

Industrial power generation gas turbine engines include a compressor for compressing air that is mixed with fuel and ignited in a combustor for generating combustion gases. The combustion gases flow to a turbine that extracts energy for driving a shaft to power the compressor and produces output power for powering an electrical generator, for example. The turbine is typically operated for extended periods of time at a relatively high base load for powering the generator to produce electrical power to a utility grid, for example. Exhaust emissions from the combustion gases are therefore a concern and are subjected to mandated limits.

More specifically, industrial gas turbine engines typically include a combustor design for low exhaust emissions operation, and in particular for low NOx operation. Low NOx combustors are typically in the form of a plurality of burner cans circumferentially adjoining each other around the circumference of the engine, each burner can having a plurality of premixers joined to the upstream end. Additionally, the combustors may comprise an annular arrangement.

Lean-premixed low NOx combustors are more susceptible to combustion instabilities as represented by dynamic pressure oscillations in the combustion chamber. The pressure oscillations, if excited, can cause undesirably large acoustic noise and accelerated high cycle fatigue damage to the combustor. The pressure oscillations can occur at various fundamental or predominant resonant frequencies and other higher order harmonics.

Such combustion instabilities may be reduced by introducing asymmetry in the heat release or for example by axially distributing or spreading out the heat release. One current method commonly used to introduce asymmetry for reducing combustion oscillations is to bias fuel to one or more burners generating more local heat release. Although this fuel-biasing method has been shown to reduce combustion instabilities, NOx emissions are substantially increased by the higher temperatures generated. Distributing the flame axially has been accomplished by physically offsetting one or more fuel injectors within the combustion chamber. A drawback to this offset approach, however, is that the extended surface associated with the downstream injectors must be actively cooled to be protected from the upstream flame. This additional cooling air has a corresponding NOx emissions penalty for the system.

Therefore, it is apparent from the above that there is a need in the art for improvements in combustor dynamics.

SUMMARY OF THE INVENTION

A variable length pre-mixer assembly comprises an upstream end for receiving compressed air from a compressor and a downstream end disposed in flow communication with a combustor. Pre-mixer assembly comprises an upstream forward clamp, a swirler assembly having a plurality of circumferentially spaced apart vanes disposed adjacent the upstream end for swirling compressed air channeled therethrough. An elongate centerbody has a first end joined to and extending through the swirler and a second end disposed downstream therefrom. A downstream fuel nozzle shroud has an outlet in flow communication with the combustor. Additionally, at least one removably disposed fuel nozzle spacer is alternatively disposed between a first position between the upstream forward clamp and the swirler assembly and a second position between the swirler assembly and the downstream fuel nozzle so as to change the relative position of the swirler assembly and alter the pre-mixer assemblies acoustical resonance characteristics.

DETAILED DESCRIPTION OF THE INVENTION

Figure 1:
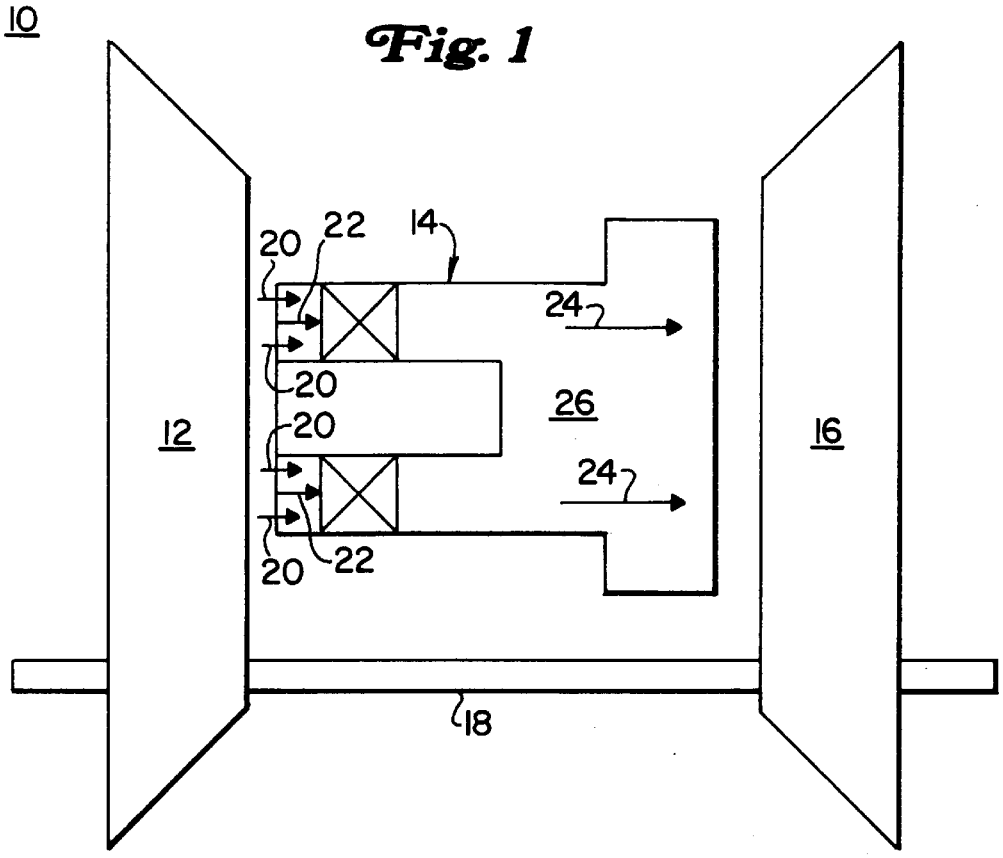
FIG. 1 is a schematic representation of an exemplary industrial turbine engine having a combustor joined in flow communication with a compressor and a turbine.

An industrial turbine engine 10 having a multistage axial compressor 12 disposed in serial flow communication with a low NOx combustor 14 and a single or multistage turbine 16 is shown in FIG. 1. Turbine 16 is coupled to compressor 12 by a drive shaft 18, a portion of which drive shaft 18 extends therefrom for powering an electrical generator (not shown) for generating electrical power, for example. Compressor 12 charges compressed air 20 into combustor 14 wherein compressed air 20 is mixed with fuel 22 and ignited for generating combustion gases or flame 24 from which energy is extracted by turbine 16 for rotating shaft 18 to power compressor 12, as well as producing output power for driving the generator or other external load.

In order to maintain suitable dynamic stability of combustor 14 during operation, the various frequencies of pressure oscillation should remain at relatively low pressure amplitudes to avoid resonance at unsuitably large pressure amplitudes leading to combustor instability expressed in a high level of acoustic noise or high cycle fatigue damage, or both. Combustor stability is conventionally effected by adding damping using a perforated combustion liner for absorbing the acoustic energy. This method, however, is undesirable in a low emissions combustor since the perforations channel film cooling air that locally quenches the combustion gases thereby increasing the CO levels. Moreover, it is preferable to maximize the amount of air reaching the premixer for reduced NOx emissions.

"Dynamic uncoupling by axial fuel staging may be better understood by understanding the apparent theory of operation of combustor dynamics as discussed in co-pending, commonly assigned, application Ser. No. 08/812,894 U.S. Pat. No. 5.943,866 entitled "Dynamically Uncoupled Low Nox Combustor,"filed on Mar. 10, 1997, which application is herein incorporated by reference."

It has been shown that Ralleigh's criteria must be met for strong oscillations to grow in a pre-mixed combustion system. This criteria suggests that instabilities grow if fluctuations in heat release are in phase with the fluctuating acoustic pressure. Accordingly, combustion instabilities can be reduced if the heat release is controlled with respect to the acoustic pressures.

Figure 2:
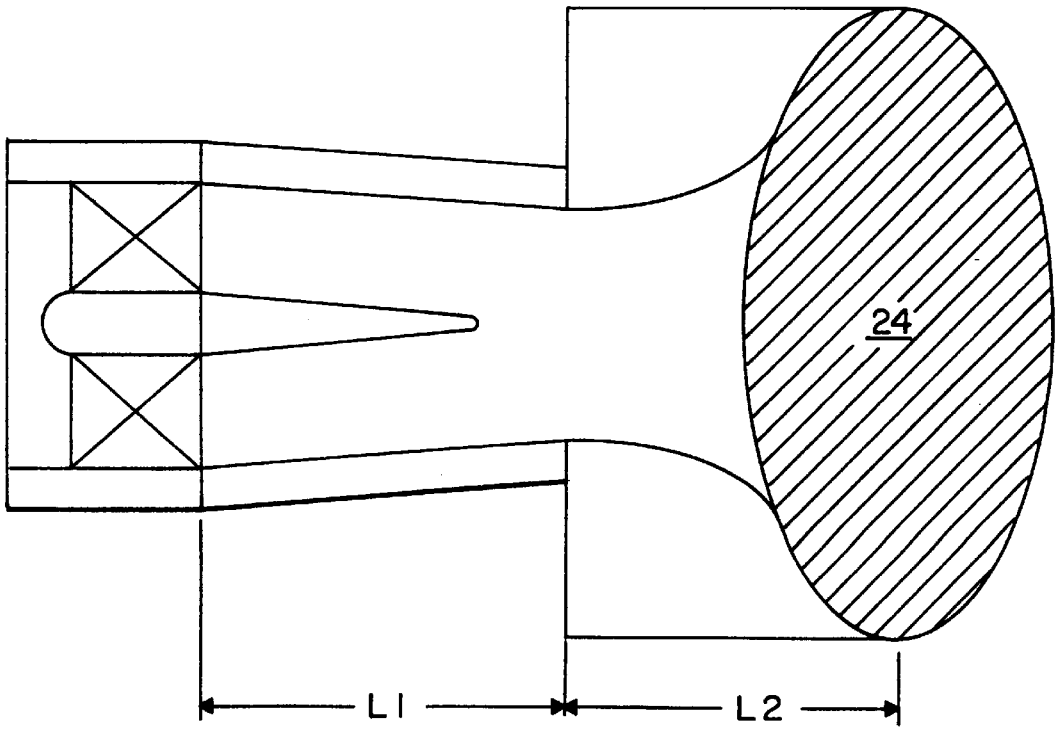
FIG. 2 is a schematic representation of a premixer and a combustor for definition of natural frequency.

The narrow duct outlet of a pre-mixer in combination with a choked turbine nozzle at the end of combustor 26 approximates an acoustic chamber. This acoustic chamber has many acoustic frequencies. The lowest order harmonic modes are the easiest to excite but the modes that achieve resonance are determined by the gains in the system. A strong source of gain in the system is the fuel-air wave that is formed due to a phase shift between the mass flow of the fuel and air. If the fuel-air wave is the dominant gain in the system then the dynamics of the system are controlled by the convective time of the fuel-air wave. The convective time is the time that it takes for fuel to travel from a fuel injection point to the zone of mean heat release in the flame, as shown schematically in FIG. 2.

The natural frequency of the pre-mixer is the inverse of the convective time. An equation that defines the natural frequency of the pre-mixer, $f_{pm}$, is given below:

$$f_{pm} = T_{convective}^{-1} = \left[\frac{L_1}{Vave_1} + \frac{L_2}{Vave_2}\right]^{-1};$$

where $L_1$ is the premixer length and $L_2$ is the distance to flame 24.

Utilizing this equation, a comparison can be made of the frequency of combustion dynamics observed in several lean premix combustors and the natural frequency of the pre-mixer.

Swirler assembly 108 comprises a plurality of circumferentially spaced apart vanes 114 disposed adjacent upstream end 102 for swirling compressed air channeled therethrough and an elongate centerbody 116 having a first end 118 joined to and extending through swirler assembly 108 and a second end 120 disposed downstream therefrom.

Downstream fuel nozzle shroud 110 includes an outlet 122 in flow communication with combustor (FIG. 1).

In one embodiment of the instant invention, fuel nozzle spacer 112 is alternatively moveable between a first position between upstream forward clamp 106 and swirler assembly 108 and a second position between swirler assembly 108 and downstream fuel nozzle shroud 110 so as to change the relative position of swirler assembly 108 and alter the acoustical resonance characteristics of pre-mixer assembly 100.

Figure 5:
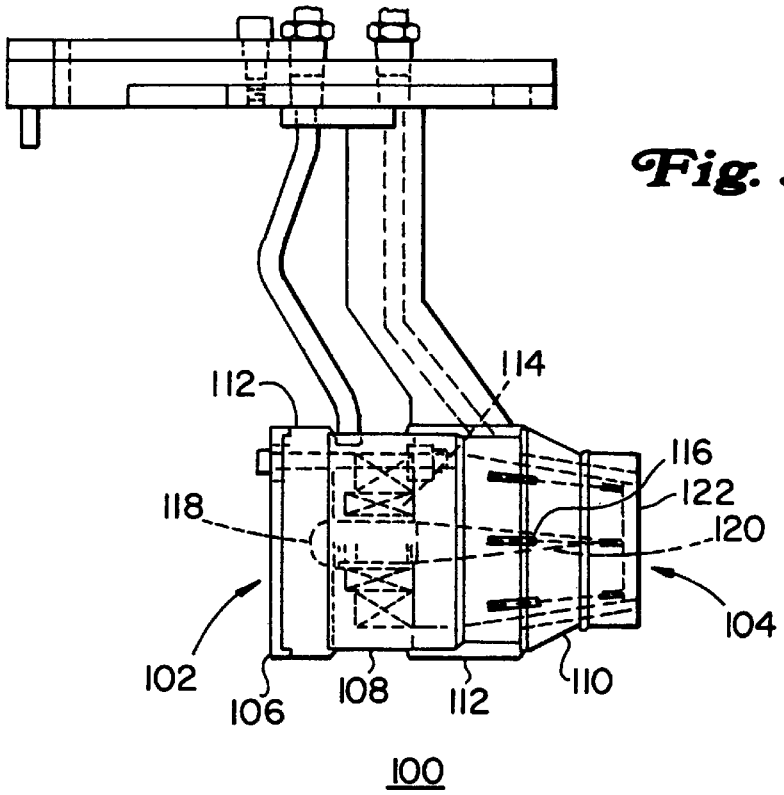
FIG. 5 is a schematic, cross-sectional side elevation view of a variable length premixer assembly in accordance with one embodiment of the instant invention.

In another embodiment of the instant invention, at least one removably disposable fuel nozzle spacer 112 comprises two fuel nozzle spacers 112, as shown in FIG. 5. The pair of fuel nozzle spacers 112 are alternatively movable to three different positions. In one assembly both fuel nozzle spacers 112 are disposed between upstream forward clamp 106 and swirler assembly 108. In a second assembly both fuel nozzle spacers 112 are disposed between swirler assembly 108 and downstream fuel nozzle shroud 110. In a third assembly, one spacer 112 is disposed between upstream forward clamp 106 and swirler assembly 108 and one spacer is disposed between swirler assembly 108 and downstream fuel nozzle shroud 110. The multiple combinations change the relative position of swirler assembly 108 and alter the acoustical resonance characteristic of premixer assembly 100

Figure 6:
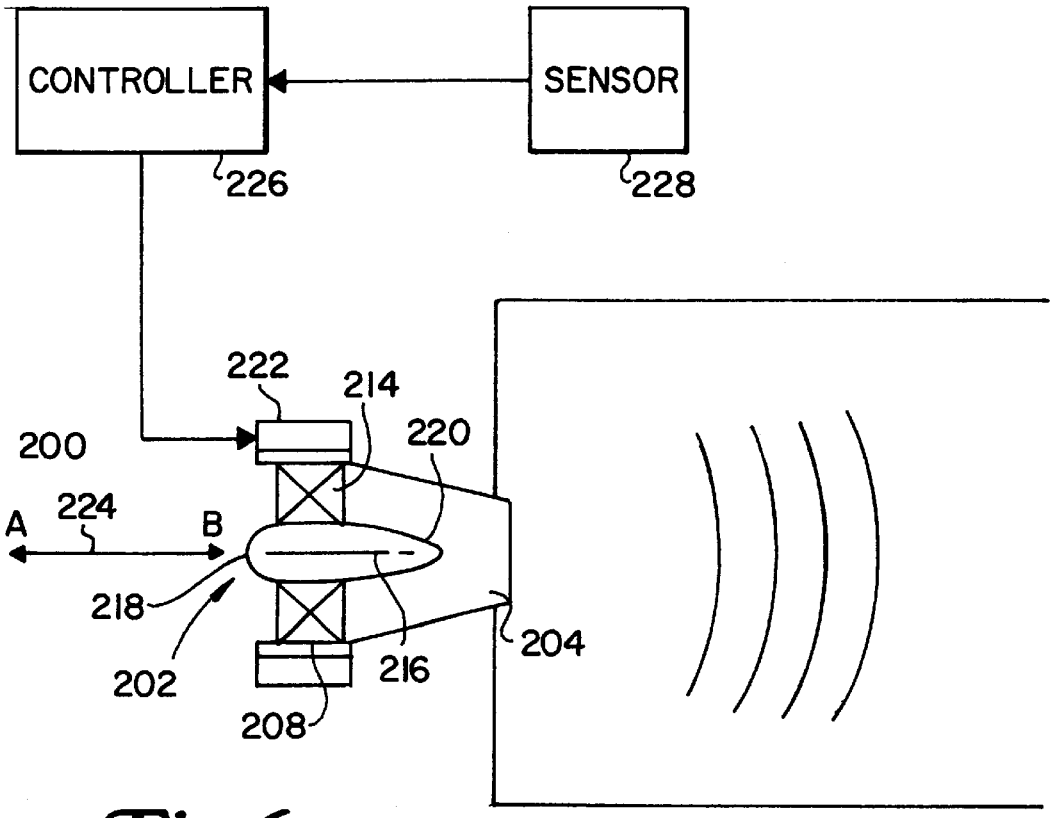
FIG. 6 is a schematic, cross-sectional side elevation view of an active controlled variable length premixer assembly in accordance with one embodiment of the instant invention.

In another embodiment of the instant invention, an actively controlled variable length premixer assembly 200 is shown in FIG. 6. Actively controlled variable length premixer assembly 200 comprises an upstream end 202 for receiving compressed air from compressor 12 (FIG. 1) and a downstream end 204 (FIG. 6) disposed in flow communications with combustor 14 (FIG. 1).

TABLE 1

| VELOCITY | PREMIXER | PREMIXER DISTANCE | DOME VELOCITY | DISTANCE TO FLAME | CONV TIME | CONV. FREQ. | OBSERV FREQ. |
|---|---|---|---|---|---|---|---|
| COMBUSTOR 1 | 300 ft/s | 2 in | 60 ft/s | 1.1 in | .0019 s | 480 HZ | 475–520 HZ |
| COMBUSTOR 2 | 220 ft/s | 7 in | 60 ft/s | 3 in | .0068 s | 146 HZ | 120–200 HZ |

As shown in table 1, there is a strong correlation between the calculated convective frequency and the observed frequency.

Figure 4:
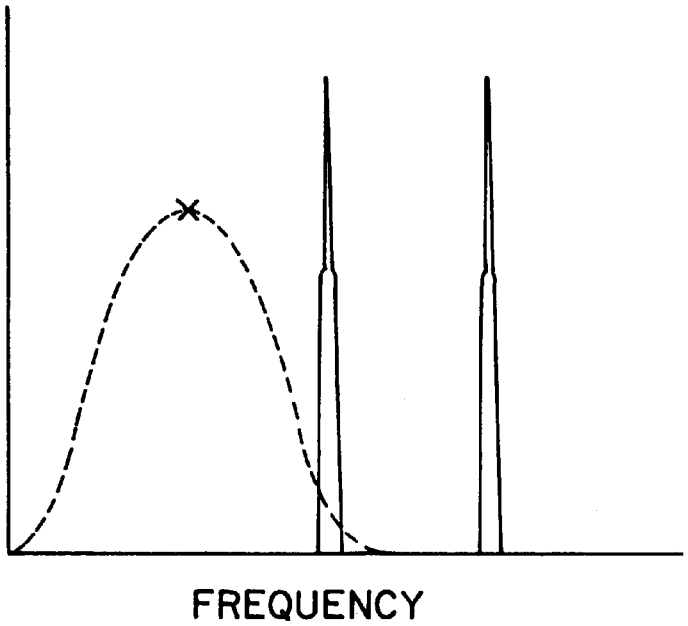
FIG. 4 is another graphical representation of the interaction between cavity acoustic mode and premixer natural frequency.
Figure 3:
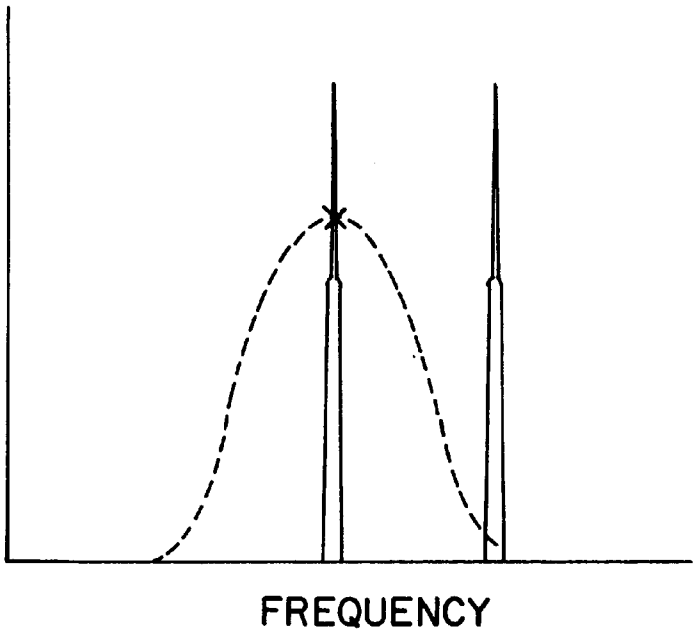
FIG. 3 is a graphical representation of the interaction between a cavity acoustic mode and a premixer natural frequency.

In a lean premixed system, the amplitude of the dynamic oscillations will depend to some extent on the proximity of the convective frequency to a resonant frequency in the cavity. As shown in FIG. 3, if the maximum gain of the fuel-air wave overlaps with the resonant frequency of the cavity, strong pressure oscillations will occur. As shown in FIG. 4, if the minimum gain of fuel-air wave overlaps with the resonant frequency of the cavity, only slight pressure oscillations will occur. An important point is that the frequency of combustion dynamics will occur near the natural frequency of the pre-mixer and not near the frequency of the cavity mode.

In accordance with one embodiment of the instant invention, a variable length pre-mixer assembly 100 is shown in FIG. 5. Variable length pre-mixer assembly 100 comprises an upstream end 102 for receiving compressed air from compressor 12 (FIG. 1) and a downstream end 104 (FIG. 5) disposed in flow communication with combustor 14 (FIG. 1).

Variable length pre-mixer assembly 100 comprises an upstream forward clamp 106, a swirler assembly 108, a downstream fuel nozzle shroud 110 and at least one removably disposable fuel nozzle spacer 112.

Premixer assembly 200 comprises a swirler assembly 208 having a plurality of circumferentially spaced apart vanes 214 disposed adjacent upstream end 202 for swirling compressed air channeled therethrough, an elongate center body 216 having a first end 218 joined to and extending through swirler assembly 208 and a second end 220 disposed downstream therefrom.

An actuator 222 is coupled to premixer assembly 200 enabling premixer assembly 200 to be movable between a fully rearward position identified by reference letter A and fully forward position identified by the reference letter B, generally along the path of arrow 224. The movement of premixer assembly 200 between position "A" and position "B" changes the relative position of premixer assembly 200 and alters the acoustic resonance characteristic of premixer assembly 200.

A controller 226 is coupled to a sensor 228 and to actuator 222 to actively control the positioning of premixer assembly 200 so as to minimize pressure oscillations. This active control is akin to "tuning" the combustor based on the signals generated by sensor 228.

While only certain features of the invention have been illustrated and described herein, many modifications and changes will occur to those skilled in the art. It is, therefore, to be understood that the appended claims are intended to cover all such modifications and changes as fall within the true spirit of the invention.

What is claimed is:

1. A variable length pre-mixer assembly comprising an upstream end for receiving compressed air from a compressor and a downstream end disposed in flow communication with a combustor, said pre-mixer assembly comprising:

an upstream forward clamp;

a swirler assembly having a plurality of circumferentially spaced apart vanes disposed adjacent said upstream end for swirling compressed air channeled therethrough and an elongate centerbody having a first end joined to and extending through said swirler assembly and a second end disposed downstream therefrom;

a downstream fuel nozzle shroud having an outlet in flow communication with said combustor; and at least one removably disposed fuel nozzle spacer;

wherein said fuel nozzle spacer is alternatively moveable between a first position between said upstream forward clamp and said swirler assembly and a second position between said swirler assembly and said downstream fuel nozzle shroud so as to change the relative position of said swirler assembly and alter said pre-mixer assemblies acoustical resonance characteristics.

2. An industrial turbine engine comprising:

a variable length pre-mixer assembly comprising an upstream end for receiving compressed air from a compressor and a downstream end disposed in flow communication with a combustor, said pre-mixer assembly comprising:

an upstream forward clamp;

a swirler assembly having a plurality of circumferentially spaced apart vanes disposed adjacent said upstream end for swirling compressed air channeled therethrough and an elongate centerbody having a first end joined to and extending through said swirler assembly and a second end disposed downstream therefrom;

a downstream fuel nozzle shroud having an outlet in flow communication with said combustor; and at least one removably disposed fuel nozzle spacer;

wherein said fuel nozzle spacer is alternatively moveable between a first position between said upstream forward clamp and said swirler assembly and a second position between said swirler assembly and said downstream fuel nozzle shroud so as to change the relative position of said swirler assembly and alter said pre-mixer assemblies acoustical resonance characteristics.

* * * * *